US006847345B2

(12) United States Patent
Kondoh

(10) Patent No.: US 6,847,345 B2
(45) Date of Patent: Jan. 25, 2005

(54) LIQUID CRYSTAL OPTICAL DEVICE

(75) Inventor: Shinya Kondoh, Nishitokyo (JP)

(73) Assignee: Citizen Watch Co., Ltd., Tokyo (JP)

( * ) Notice: Subject to any disclaimer, the term of this patent is extended or adjusted under 35 U.S.C. 154(b) by 304 days.

(21) Appl. No.: 10/252,523

(22) Filed: Sep. 24, 2002

(65) Prior Publication Data

US 2003/0080933 A1 May 1, 2003

(30) Foreign Application Priority Data

Sep. 27, 2001 (JP) ..... 2001-295256
Nov. 2, 2001 (JP) ..... 2001-337279
Sep. 2, 2002 (JP) ..... 2002-256547

(51) Int. Cl.[7] ..... G09G 3/36
(52) U.S. Cl. ..... 345/97; 345/96
(58) Field of Search ..... 345/87, 89, 90, 345/91, 92, 93, 96, 97, 98

(56) References Cited

U.S. PATENT DOCUMENTS 6,509,887 B1 * 1/2003 Kondoh et al. ..... 345/87
6,545,653 B1 * 4/2003 Takahara et al. ..... 345/87
6,567,065 B1 * 5/2003 Kondoh et al. ..... 345/97
6,724,360 B2 * 4/2004 Kondoh ..... 345/97
2002/0180673 A1 * 12/2002 Tsuda et al. ..... 345/87

FOREIGN PATENT DOCUMENTS

| | | |
|---|---|---|
| EP | 0 919 849 | 6/1999 |
| EP | 1 045 270 | 10/2000 |
| JP | 63085523 | 4/1988 |
| JP | 63085524 | 4/1988 |
| JP | WO 98/59274 | 12/1998 |
| JP | WO 00/08518 | 2/2000 |

* cited by examiner

*Primary Examiner*—Vijay Shankar
(74) *Attorney, Agent, or Firm*—Finnegan, Henderson, Farabow, Garrett & Dunner, L.L.P.

(57) ABSTRACT

Disclosed is a liquid crystal optical device which produces a color display by using a light source mounted behind a liquid crystal panel and capable of emitting a plurality of different colors, wherein the period from the time the light source mounted on the back emits one color to the time the light source switches to the next color is set as a scanning period, and the scanning period comprises a selection period (Se), a non-selection period (NSe), and a reset period (Rs), the length of the reset period being equal to one half the scanning period, and wherein a black display state is effected in the reset period (Rs).

9 Claims, 15 Drawing Sheets

LIQUID CRYSTAL OPTICAL DEVICE

BACKGROUND OF THE INVENTION

1. Field of the Invention

The present invention relates to a liquid crystal optical device constructed by combining a liquid crystal panel having a liquid crystal layer with a light source capable of emitting a plurality of different colors.

2. Description of the Related Art

Various methods have been proposed in the prior art to achieve a color display utilizing a phenomenon called successive additive color mixing by using a liquid crystal panel as a shutter with a light source (for example, an LED or a CRT) mounted behind it. Prior art literature relating to such methods includes, for example, "4. A Full-Color Field-Sequential Color Display," presented by Philip Bos, Thomas Buzak, and Rolf Vatne at Eurodisplay '84, France, pp. 7–9, Sep. 18–20, 1984. The successive additive color mixing method, unlike methods that use color filters or the like with respective color segments provided at each pixel position of the liquid crystal panel, achieves color display by successively projecting colored lights by rapidly switching between different-colored light sources. For the liquid crystal panel used with this method, a structure equivalent to that of a monochrome liquid crystal panel can be used. The light source disposed behind the panel emits three colored lights, for example, R (red), G (green), and B (blue), each for a predetermined duration of time, and the respective colored lights are projected in sequence (for example, in the order of R, G, and B) in time division fashion. The liquid crystal panel is controlled to turn on or off each display pixel in a manner synchronized to the predetermined duration of time. The light transmission state of each of the R, G, and B colors is determined by turning on or off the pixel in the liquid crystal cell in accordance with the desired color information. As the time that each of the single colored lights is projected is very short, the human eye perceives the respective colors, not as individually separate colors, but as one color produced by mixing the respective colors.

Next, as one method for driving the liquid crystal panel, a time division driving method will be described. FIG. 1 is a diagram showing matrix electrodes. As shown in FIG. 1, scanning electrodes (X1, X2, X3, X4, . . . , Xn) and signal electrodes (Y1, Y2, Y3, . . . , Ym) are respectively formed on a pair of substrates. To drive the matrix array of pixels located at the intersections of the respective electrodes, a voltage is applied to the scanning electrodes in sequence and, in synchronism with the application of the scanning electrode voltage, a voltage waveform corresponding to the display state is applied from each signal electrode. The light transmission state of each pixel is determined by the sum of the voltage waveforms applied to the signal electrode and scanning electrode associated with the pixel, and the display state is thus written to the pixel. More specifically, to write to one pixel, the transmittance, i.e., the light transmission state, of the pixel is determined by the sum of the voltage waveform applied to the scanning electrode (Xn) and the voltage waveform applied to the signal electrode (Ym).

Various types of liquid crystals can be used for liquid crystal panels that achieve a color display by utilizing the phenomenon of successive additive color mixing. For example, antiferroelectric liquid crystals and ferroelectric liquid crystals exhibiting ferroelectric properties, as well as TN type liquid crystals and STN type liquid crystals, can be used. Among them, liquid crystals exhibiting ferroelectric properties, because of their fast response times, are preferred for use as the liquid crystal material when using different-colored light sources in accordance with the successive additive color mixing method. As a technique for applying such time-division light emitting sources to ferroelectric liquid crystal panels, the prior art discloses a driving method that switches the light emission from one color to the next in a plurality of frames (scanning periods) (for example, refer to Japanese Unexamined Patent Publication Nos. S63-85523 (FIG. 1) and S63-85524 (FIG. 1)).

Next, a detailed description will be given below of a driving method for a liquid crystal panel constructed using an antiferroelectric liquid crystal.

FIG. 2 is a schematic diagram showing the arrangement of polarizers in a liquid crystal panel constructed using an antiferroelectric liquid crystal. Between the polarizers 21*a* and 21*b*, whose polarization axes a' and b' are arranged in a crossed Nicol configuration, is placed a liquid crystal cell 22 in such a manner that the average long axis n of antiferroelectric liquid crystal molecules, when no electric field is applied, is oriented substantially parallel to the polarization axis of either one of the polarizers (in the diagram, the polarization axis a') so that the liquid crystal cell is put in a non-transmissive state (closed state) when no voltage is applied and in a transmissive state (open state) when a voltage is applied. Alternatively, the arrangement may be made so that, when the antiferroelectric liquid crystal exhibits a first ferroelectric state or a second ferroelectric state to be described later, the long axis of the liquid crystal molecules is oriented parallel to the polarization axis of either one of the polarizers. In this arrangement, when the liquid crystal exhibits the ferroelectric state in which the long axis of the molecules is parallel to the polarization axis, the liquid crystal panel is put in the non-transmissive state, and when no voltage is applied, the liquid crystal panel is in the transmissive state. Either arrangement is possible, but the following description deals with the liquid crystal panel in which the polarization axis of one of the polarizers is oriented parallel to the average direction of the molecules in an antiferroelectric state when no voltage is applied.

When a voltage is applied across the thus arranged liquid crystal cell, its light transmittance varies with the applied voltage, describing a loop as plotted in the graph of FIG. 3. When a voltage of first polarity is applied, the voltage value at which the transmittance begins to change when the applied voltage is increased is denoted by V1, and the voltage value at which the transmittance reaches saturation is denoted by V2, while the voltage value at which the transmittance begins to drop when the applied voltage is decreased is denoted by V5; further, when a voltage of opposite polarity is applied, the voltage value at which the transmittance begins to change when the absolute value of the applied voltage is increased is denoted by V3, and the voltage value at which the transmittance reaches saturation is denoted by V4, while the voltage value at which the transmittance begins to change when the absolute value of the applied voltage is decreased is denoted by V6. As can be seen from FIG. 3, when the voltage value exceeds the threshold, the first ferroelectric state is selected, and when the voltage of the second polarity opposite to the first polarity is applied, the second ferroelectric state is selected; in these ferroelectric states, when the voltage value drops below a certain threshold, an antiferroelectric state is selected.

FIG. 4 shows driving voltage waveforms for driving the antiferroelectric liquid crystal panel in a time-division fashion. The electrodes are formed on the respective substrates as shown in FIG. 1. The voltage waveform applied to a scanning electrode (Xn), the voltage waveform applied to a signal electrode (Ym), and the sum of the voltage waveforms applied to the pixel (Anm) at the intersection of the electrodes are shown in FIG. 4. The amount of light transmission (T) of the pixel changes according to the sum voltage waveform of FIG. 4; ON(W) indicates the white display state which is the transmissive state, and OFF(B) indicates the black display state which is the non-transmissive state. The period during which the voltage is applied sequentially to all the scanning electrodes is the scanning period (frame period) and, in a reset period (Re), the liquid crystal is forced into a prescribed state, in the illustrated example, the antiferroelectric state. In the selection period (Se) that follows, when the first or the second ferroelectric state is selected, the liquid crystal is put in the ON(W) state, i.e., the transmissive state, while when the antiferroelectric state is selected in the selection period (Se), the liquid crystal is put in the OFF(B) state, i.e., the non-transmissive state; in the non-selection period (NSe) that follows, the temporal change of the selected state is controlled.

As described above, in the antiferroelectric liquid crystal panel, it is generally practiced to reset the antiferroelectric liquid crystal to the first or second ferroelectric state or the antiferroelectric state immediately before writing to the pixel. For example, in FIG. 4, the selection period (Se) is immediately preceded by the reset period (Re), and in this reset period, a voltage lower than the threshold voltage is applied to the pixel to reset it to the antiferroelectric state. In this way, by resetting the state of each pixel immediately before writing necessary information to the pixel, a good display can be produced with each pixel being unaffected by its previously written state.

Next, a ferroelectric liquid crystal panel will be described in detail. It is known that, generally, a ferroelectric liquid crystal molecule moves in such a manner as to rotate along the lateral surface of a cone (hereinafter called the "liquid crystal cone") when an external force such as an electric field is applied. In a liquid crystal panel constructed by sandwiching a ferroelectric liquid crystal between a pair of substrates, the ferroelectric liquid crystal is controlled by the polarity of the applied voltage so that the liquid crystal molecules lie in one of two positions on the lateral surface of the liquid crystal cone. These two stable states of the ferroelectric liquid crystal are called the first ferroelectric state and the second ferroelectric state, respectively.

FIG. 5 shows one example of the arrangement of a ferroelectric liquid crystal panel constructed using a ferroelectric liquid crystal. A liquid crystal cell 22 formed by sandwiching the ferroelectric liquid crystal between a pair of substrates is placed between polarizers 21*a* and 21*b* whose polarization axes are arranged substantially at right angles to each other (crossed Nicol configuration), in such a manner that the polarization axis of either one of the polarizers is parallel to either the long axis n1 of the molecules in the first ferroelectric state or the long axis n2 of the molecules in the second ferroelectric state when no voltage is applied. In the example of FIG. 5, the polarizers are arranged so that the polarization axis a' of the polarizer 21*a* is substantially parallel to the long axis direction n2 of the ferroelectric liquid crystal molecules in the second ferroelectric state.

In the polarizer arrangement shown in FIG. 5, when the ferroelectric liquid crystal is put in the ferroelectric state in which the long axis of the molecules is oriented parallel to the direction of the polarization axis of one of the polarizers (in the illustrated example, the second ferroelectric state), light does not pass through, and the ferroelectric liquid crystal panel therefore produces a black display (non-transmissive state). Depending on the polarity of the applied voltage, the ferroelectric liquid crystal is switched to the other ferroelectric state in which the long axis of the molecules is not made to coincide with the polarization axis of the polarizer; in this state, as the ferroelectric liquid crystal molecules tilt at a certain angle relative to the polarization axis, light from a backlight is transmitted therethrough and a white display can thus be produced (transmissive state in which the transmittance is high). In the illustrated example, the polarizers are arranged with the polarization axis of one of the polarizers oriented so as to coincide with the long axis direction of the liquid crystal molecules in the second ferroelectric state but, alternatively, the polarizers may be arranged so that the direction of the polarization axis coincides with the long axis direction n1 of the liquid crystal molecules in the first ferroelectric state. In that case, the black display state (non-transmissive state) can be produced in the first ferroelectric state, and the white display state (high-transmittance state) in the second ferroelectric state. Either arrangement can be employed in the present invention, but the following description is given by taking as an example the case where the arrangement shown FIG. 5 is employed.

FIG. 6 shows the relationship between the value of the voltage applied to the ferroelectric liquid crystal panel and the light transmittance of the ferroelectric liquid crystal panel. As shown in FIG. 6, when a voltage of first polarity (positive polarity) greater in magnitude than a certain value is applied to the ferroelectric liquid crystal, the ferroelectric liquid crystal exhibits the first ferroelectric state; in this state, light can pass through the ferroelectric liquid crystal panel and, hence, is in the high-transmittance state. Conversely, when a voltage of second polarity (negative polarity) greater in magnitude than a certain value is applied, the ferroelectric liquid crystal exhibits the second ferroelectric state, the non-transmissive state, in which no light is allowed to pass through. As can be seen from the figure, the light transmittance of the ferroelectric liquid crystal is maintained even when the applied voltage becomes 0 V; that is, the display state, once written, can be retained even after the externally applied voltage is removed.

FIG. 7 shows typical driving voltage waveforms for the ferroelectric liquid crystal panel having the polarizer arrangement shown in FIG. 5. The electrode arrangement is the same as that shown in FIG. 1. As shown, the amount of light (light transmittance) transmitted through one pixel in the ferroelectric liquid crystal panel changes according to the applied voltage; ON (W) designates the white display state in which the transmittance is high, and OFF (B) indicates the non-transmissive state, i.e., the black display state. The voltage applied to the pixel (Anm) in the ferroelectric liquid crystal panel can be expressed as a sum voltage waveform representing the sum of the scanning voltage waveforms applied to the scanning electrode (Xn) and the signal voltage waveform applied to the signal electrode (Ym).

The driving voltage waveform shown in FIG. 7 has one scanning period (frame period) in order to produce a display based on display data for one frame. Each frame period includes a selection period (Se) for selecting the display state based on the display data and a non-selection period (NSe) for holding the selected display state; here, the selection period is preceded by a reset period (Rs) for resetting, irrespective of the previously display state, the ferroelectric liquid crystal to one of the ferroelectric states before writing the next display data. In FIG. 7, a pulse of positive polarity for forcing the ferroelectric liquid crystal into the first ferroelectric state, i.e., the white display state (high-transmittance state), is applied in the first half of the reset period, and a pulse of negative polarity, for resetting the ferroelectric liquid crystal to the second ferroelectric state, i.e., the black display state (non-transmissive) state, is applied in the second half of the reset period. In this way, in the ferroelectric liquid crystal panel, in order to produce a good display, it is generally practiced to provide a reset period for switching the ferroelectric liquid crystal between the two ferroelectric states, irrespective of the immediately preceding display state, by applying pulses of opposite polarities.

As a grayscale display method for a ferroelectric liquid crystal panel having only two states, i.e., the first ferroelectric state and the second ferroelectric state, it is practiced to provide a voltage gradient within the same pixel and thus distribute threshold voltages within the same pixel, or to split each one pixel into a plurality of pixels and apply a voltage individually to each split pixel, thereby achieving a grayscale display based on the ratio between the area of the high-transmittance white display state and the area of the non-transmissive state.

When driving the liquid crystal panel by using the earlier described successive additive color mixing method, if the period from the time the light emitting device mounted as a light source behind the liquid crystal panel emits a certain color to the time it emits the next color is set as the scanning period, the scanning period must be made shorter than about 20 ms in order to prevent changes in the color of light emitted from the light source from being perceived as flicker by the human eye. In that case, when, for example, the response speed of the liquid crystal and the performance of the currently available liquid crystal materials are considered, if the number of scanning electrodes is 100 or larger, a voltage can be applied to each scanning electrode only once within the scanning period.

In the conventional time-division driving method, the selection period is provided in sequence starting from the first scanning electrode. When there are 100 scanning electrodes, for example, the number of scanning electrodes is large, and the location of the selection period for the endmost scanning electrode is delayed compared with that for the first scanning electrode. As a result, as the scanning progresses from the first scanning electrode toward the n-th scanning electrode, the amount of light transmission decreases. FIG. 8 is a diagram showing bar graphs, in which the vertical axis corresponds to the scanning electrode location and the horizontal axis represents the length of time that light is transmitted through the pixels on each scanning electrode in the white display state. That is, when producing, for example, a white display, within the time during which the same light is emitted the length of time that the light is allowed to transmit through the pixels differs from one scanning electrode to the next as shown in FIG. 8, and uniform brightness cannot be obtained over the entire screen. Further, if the light emission is switched from one color to the next in a plurality of frames as in the prior art, the number of times that the voltage is applied to each scanning electrode increases correspondingly, and flicker occurs.

SUMMARY OF THE INVENTION

In view of the above problems, it is an object of the present invention to provide a liquid crystal optical device that produces a display on a liquid crystal panel by utilizing the phenomenon of successive additive color mixing, and that achieves a good display with uniform brightness over the entire liquid crystal panel regardless of the location of the respective scanning electrodes.

To attain the above object, the liquid crystal optical device of the present invention is characterized in that the period from the time one colored light is emitted to the time switching is made to another colored light is set as a scanning period, and in that, for each electrode, the scanning period comprises a selection period for determining transmittance state based on display data and a reset period for resetting the transmittance state to a certain transmittance state irrespectively of the display data, wherein the length of the reset period is set approximately equal to one half the length of the scanning period. Preferably, in the reset period, the transmittance state is reset to a non-transmissive state, and the length of the selection period multiplied by the number of scanning electrodes is set approximately equal to one half the length of the period during which a backlight is emitting the same colored light.

Further, the liquid crystal optical device of the invention is characterized in that the liquid crystal is an antiferroelectric liquid crystal which exhibits a first ferroelectric state when a voltage of first polarity is applied, a second ferroelectric state when a voltage of second polarity is applied, and an antiferroelectric state when no voltage is applied, and in that the liquid crystal panel includes a pair of polarizers, the pair of polarizers being arranged so that the polarization axis of either one of the polarizers is oriented substantially parallel to the average molecular direction of the antiferroelectric liquid crystal in the antiferroelectric state, wherein in the reset period, the antiferroelectric liquid crystal is reset to the antiferroelectric state.

In this case, in order that the liquid crystal is maintained in the non-transmissive state during the reset period, the applied voltage is set so that a voltage lower than a threshold voltage is applied to the liquid crystal cell throughout the reset period. Further, the electrodes of the liquid crystal panel consists of scanning electrodes and signal electrodes, and preferably, the voltage to be applied to each of the scanning electrode during the reset period is set to 0 V.

Alternatively, the liquid crystal may be a ferroelectric liquid crystal which exhibits a first ferroelectric state when a voltage of a first polarity is applied and a second ferroelectric state when a voltage of a second polarity is applied; in this case, the pair of polarizers is arranged so that the polarization axis of either one of the polarizers is oriented substantially parallel to the molecular direction of the ferroelectric liquid crystal in the second ferroelectric state wherein, in the reset period, the ferroelectric liquid crystal is reset to the second ferroelectric state.

The electrodes are arranged as a matrix of scanning electrodes and signal electrodes and, to drive the matrix array of pixels located at the intersections of the respective electrodes, a time-division driving method may be used in which a voltage is applied to the scanning electrodes one at a time and, in synchronism with the application of the scanning electrode voltage, a voltage waveform corresponding to the display state is applied from each signal electrode. Alternatively, a driving method that uses an active device at each pixel position may be used.

According to the liquid crystal optical device of the present invention, as the data display time in the scanning period is set equal for all the scanning electrodes, a good display can be produced uniformly over the entire display screen by eliminating unevenness in brightness within the display screen. The same effect can be achieved for any type of liquid crystal panel, whether it be a liquid crystal panel constructed using an antiferroelectric or ferroelectric liquid crystal exhibiting ferroelectric properties, or an STN liquid crystal or TN liquid crystal, or whether it be a liquid crystal panel using active devices.

DESCRIPTION OF THE PREFERRED EMBODIMENTS

In the liquid crystal optical device of the present invention, a light source capable of successively projecting different colored lights is mounted as a backlight behind a liquid crystal panel. For example, LEDs that emit colored lights of red (R), green (G), and blue (B), respectively, are arranged in a plane. A driving method will be described below for the case in which three colored light sources of R, G, and B are used. To write desired display state to a pixel, the light sources of R, G, and B are operated in sequence to emit the respective colors, each for a given duration of time, and during the emission of each color, a voltage is applied to all the scanning electrodes in sequence. More specifically, when the period from the time one color is emitted to the time the light is switched to the next color is set as the scanning period (one frame period), necessary information is written to the pixel by illuminating R, G, and B in sequence. That is, in this case, three frame periods are required to write the necessary information to one pixel.

Here, a reset period for resetting the liquid crystal panel, a selection period for determining the display state of the pixel by applying a designated voltage, and a non-selection period for controlling the variation of the determined display state are provided within the scanning period, i.e., the emission period of each colored light source. When the three colored light sources of R, G, and B are used, the reset period, the selection period, and the non-selection period are repeated for each of the R, G, and B emission periods.

In the reset period, the liquid crystal panel is always reset to the black display state irrespectively of the display data. The length of this reset period is set approximately equal to one half the length of the scanning period, and the length of the selection period multiplied by the number of scanning electrodes is set approximately equal to the length of the reset period. In this driving method, as one half of the scanning period is the period of black display state regardless of the scanning electrode location, the length of time that light is allowed to pass through is equal for all the electrodes, that is, for all the pixels.

(Embodiment 1)

Figure 9:
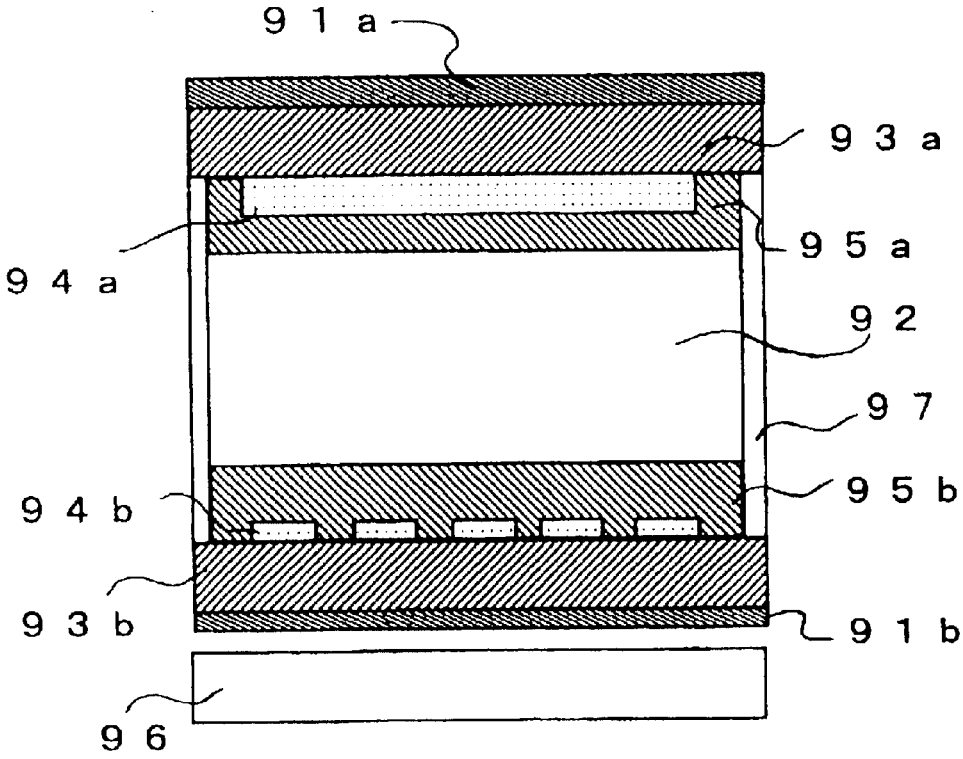
FIG. 9 is a diagram showing the structure of a liquid crystal panel used in the present invention.

The present invention will be described in detail below with reference to drawings. FIG. 9 is a diagram showing the structure of the liquid crystal panel used in the embodiment of the present invention. The liquid crystal used in this embodiment is an antiferroelectric liquid crystal, and the antiferroelectric liquid crystal panel comprises a pair of glass substrates 93*a* and 93*b* holding therebetween the antiferroelectric liquid crystal as a liquid crystal layer 92 about 2 $\mu$m thick, and a sealing material 97 for bonding the two glass substrates together. On the opposing surfaces of the glass substrates are formed electrodes (ITO) 94*a* and 94*b*, which are coated with alignment films 95*a* and 95*b*, respectively, and treated by rubbing. On the outside surface of one glass substrate is disposed a first polarizer 91*a* with its polarization axis oriented parallel to the rubbing axis, while on the outside surface of the other glass substrate, a second polarizer 91*b* is arranged with its polarization axis oriented at 90° to the polarization axis of the first polarizer 91*a*. LEDs capable of emitting three colored lights (R, G, and B), respectively, are mounted as a backlight 96 behind the liquid crystal panel. The backlight 96 is operated to emit light of R, G, and B in this order, each color for a duration of about 5.6 ms.

Figure 1:
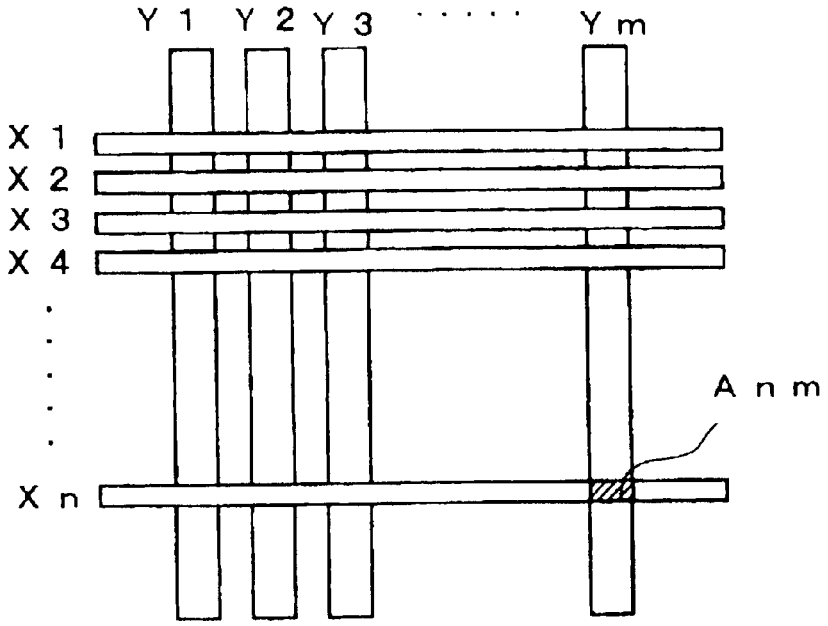
FIG. 1 is a diagram showing matrix electrodes.
Figure 2:
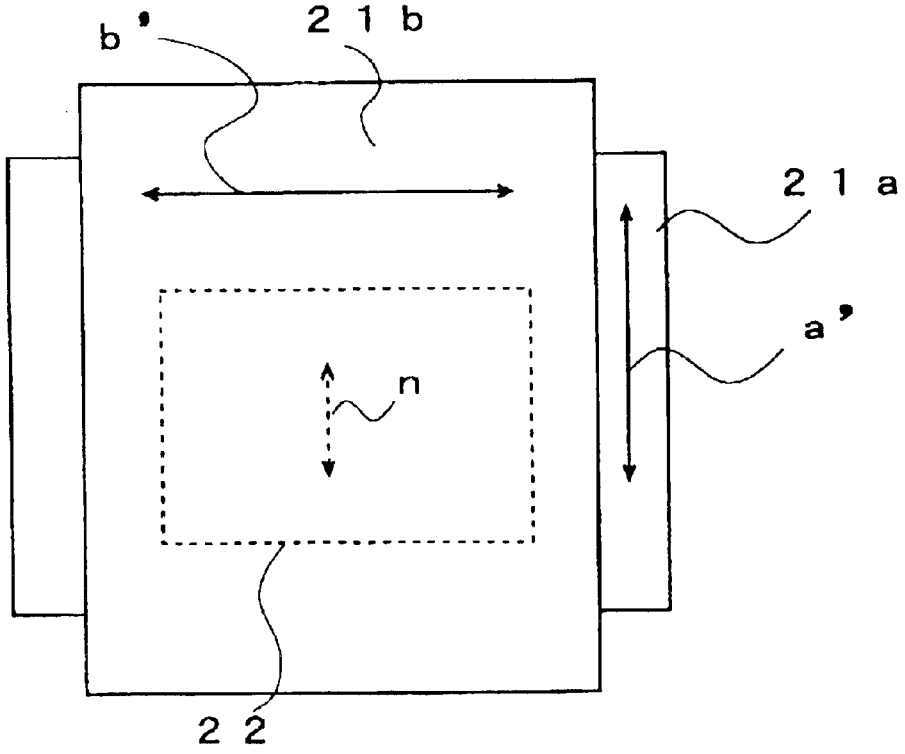
FIG. 2 is a diagram showing the arrangement of an antiferroelectric liquid crystal panel and polarizers.
Figure 3:
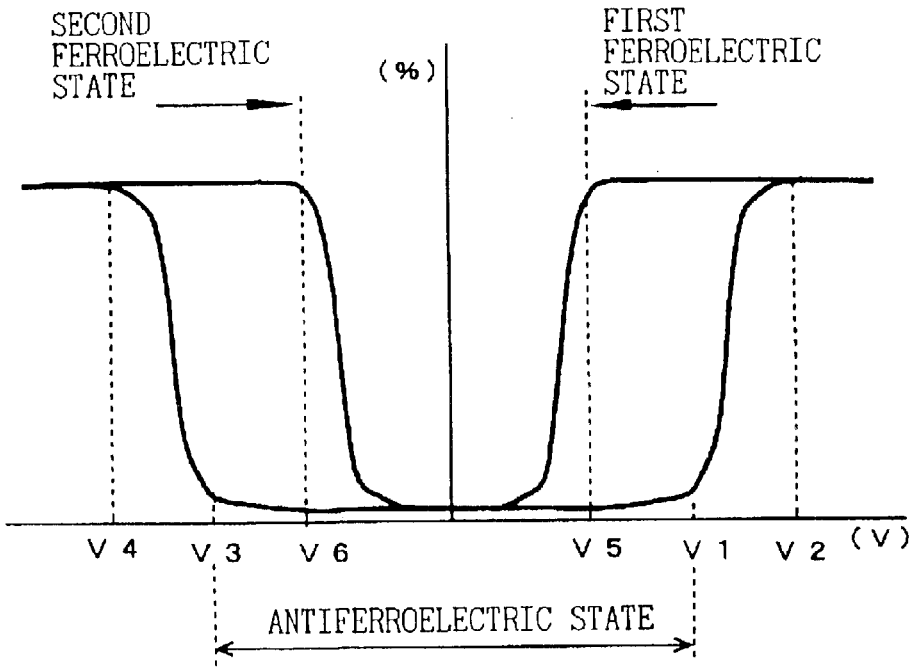
FIG. 3 is a diagram showing a hysteresis curve for the antiferroelectric liquid crystal panel.
Figure 4:
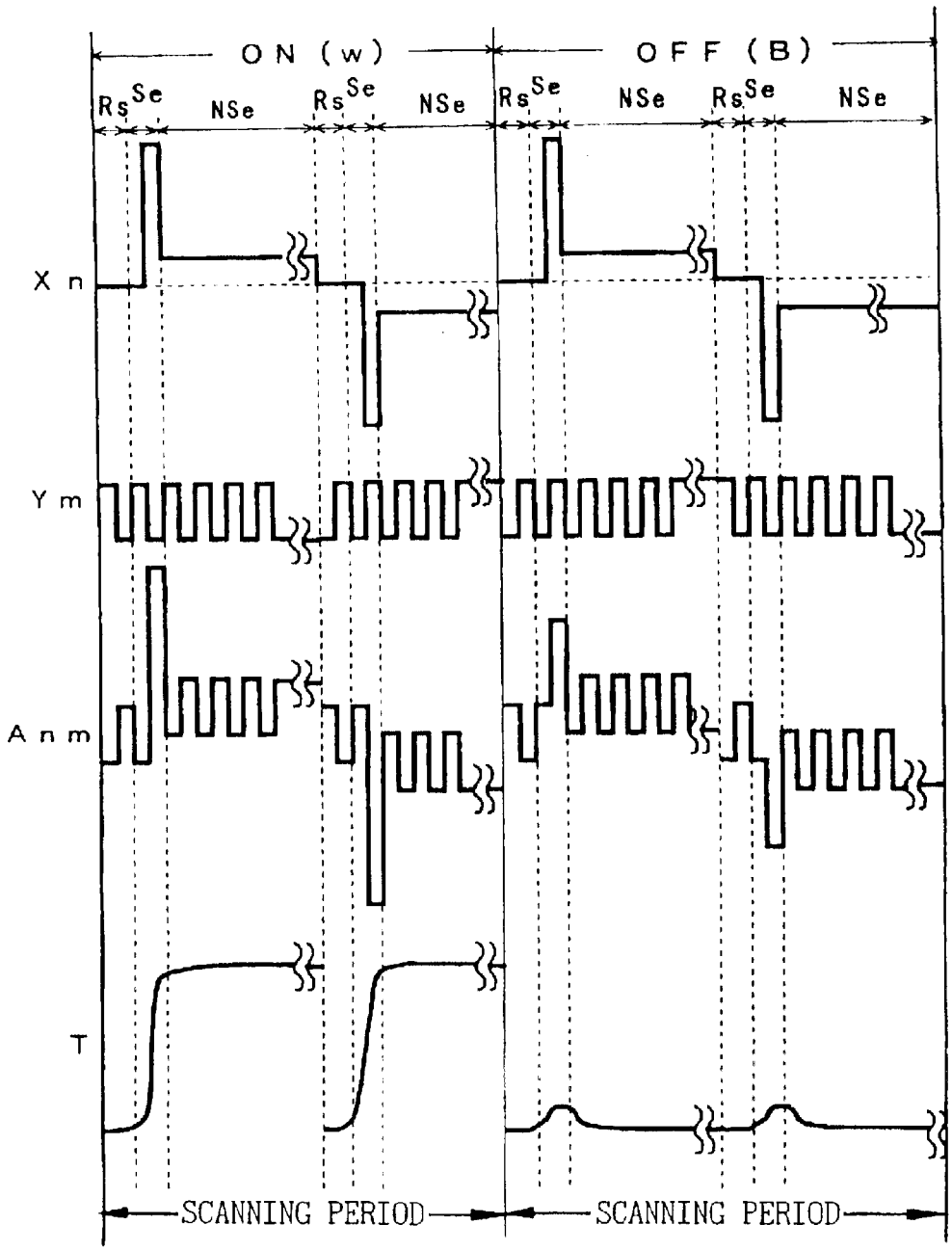
FIG. 4 is a diagram showing driving voltage waveforms and their corresponding light transmittance for a conventional art antiferroelectric liquid crystal panel.

In this antiferroelectric liquid crystal panel, the scanning electrodes and signal electrodes are arranged in a matrix as previously shown in FIG. 1. The scanning electrodes are disposed at X1, X2, . . . , Xn, and the signal electrodes at Y1, Y2, . . . , Ym. In this example, the number of scanning electrodes is 160, and the number of signal electrodes is also 160. A pixel is formed at each intersection (shaded portion) of the electrodes; the pixel located at the intersection of the scanning electrode Xn and the signal electrode Ym is designated by Anm.

Figure 10:
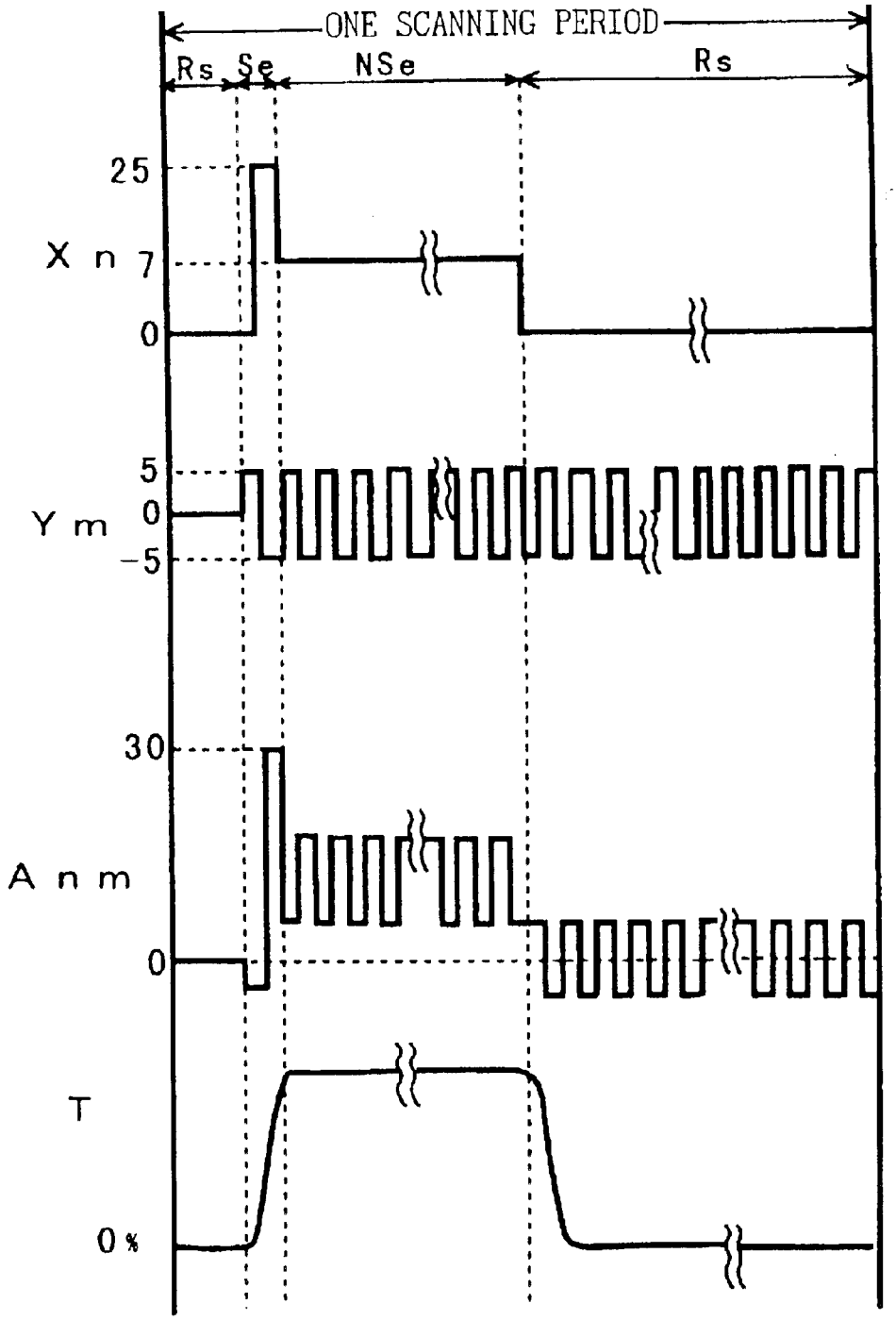
FIG. 10 is a diagram showing driving waveforms and their corresponding light transmittance for a liquid crystal optical device according to the present invention.

FIG. 10 shows the driving voltage waveforms according to the present invention. The driving waveforms are shown for the case when the period from the time one color is emitted to the time the light is switched to the next color is set as the scanning period, and when white display state (ON(W)) is effected as the transmissive state. In the figure, only the scanning voltage waveform applied to one scanning electrode is shown but, actually, the voltage is applied to all the scanning electrodes in sequence during the scanning period. Besides the scanning voltage waveform applied to the scanning electrode (Xn) and the signal voltage waveform applied to the signal electrode (Ym), the sum of the driving voltage waveforms applied to the pixel (Anm) located at their intersection and the amount of light transmission (T) changing with the sum voltage waveform are shown here. Though the scanning electrode and the signal electrode are designated by Xn and Ym, respectively, the sum driving voltage waveform shown is the waveform applied to the pixel at an arbitrary position, not specifically the pixel at the intersection of the 160th scanning electrode and signal electrode.

During the scanning period (frame period) which is equal to the period from the time the light of one color is emitted to the time the light is switched to the next color, the voltage waveforms for the selection period, the non-selection period, and the reset period are applied to the respective electrodes. The selection period (Se) consists of two phases, and the length of the selection period is set equal to one half the length of the scanning period divided by the total number of scanning electrodes. The length of the scanning period is about 5.4 ms. As for the scanning voltage waveform applied to the scanning electrode (Xn), in the selection period a pulse of a peak value of 25 V is applied, the pulse width of one phase being about 8.3 $\mu$s, and in the non-selection period (NSe), a voltage of about 7 V is applied. In the reset period (Rs), the liquid crystal is reset to a certain transmittance state irrespective of the display data, and held in that state for 2.6 ms which is equal to one half the length of the scanning period. For the scanning electrode, two reset periods are provided within the scanning period, one at the beginning of the scanning period and the other in the second half thereof. In each reset period, a voltage of 0 V is applied to the scanning electrode.

The signal voltage waveform applied to the signal electrode (Ym) is a pulse waveform of ±5 V, the pulse width varying according to the display data. Though not shown here, for each scanning period (each of the R, G, and B light emissions), that is, each time the color of the light source changes, the polarities of the scanning electrode voltage waveform and the signal electrode voltage waveform are inverted symmetrically about 0 V to prevent degradation of the liquid crystal by a direct current.

When attention is paid to the sum voltage waveform applied to the pixel (Anm), in the selection period, a voltage of 30 V corresponding to the display data is applied, and the antiferroelectric liquid crystal takes the first ferroelectric state, i.e., the high-transmittance state, producing a white display. In the non-selection period, this state is maintained, retaining the white display state. In the reset period that follows, the sum voltage waveform of ±5 V is applied, thereby resetting the antiferroelectric liquid crystal to the antiferroelectric state, i.e., the non-transmissive black display state, irrespective of the display data.

Figure 11:
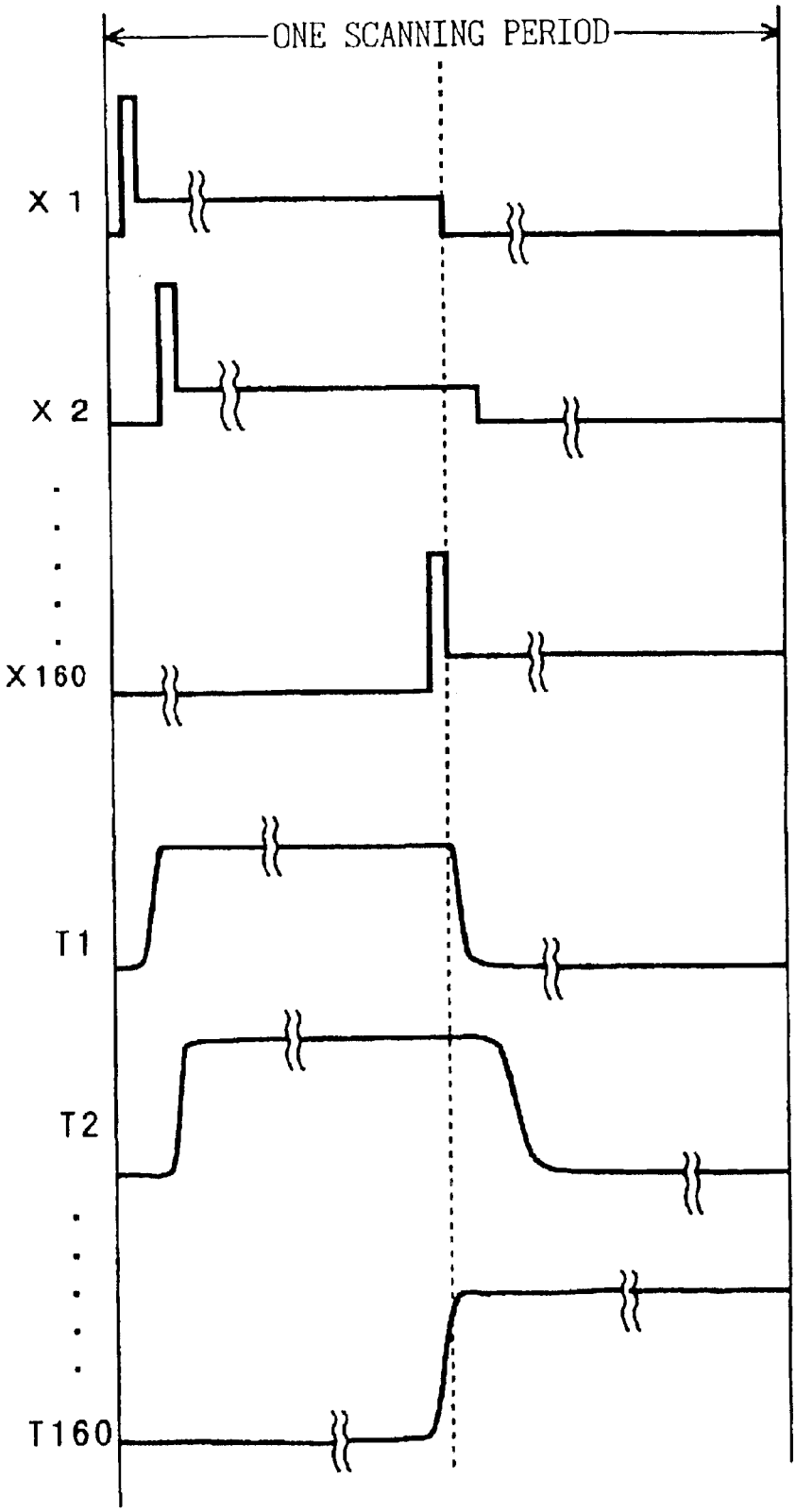
FIG. 11 is a diagram showing driving waveforms and their corresponding light transmittance for the liquid crystal optical device according to the present invention.

While FIG. 10 has shown the driving waveforms for one particular pixel, FIG. 11 shows the scanning voltage waveforms applied to the first scanning electrode (X1), the second scanning electrode (X2), and the 160th scanning electrode (X160), and the amounts of light transmission (T1, T2, and T160) when the plurality of pixels on the respective electrodes are displayed in the white display state. As shown in FIG. 11, for X1, the second half of the scanning period is the reset period, and for X160, the selection period is located at the end of the first half. The pixels are reset to the non-transmissive state in the reset period; though the reset period is displaced from one scanning electrode to the next, the pixels-are held in the black display state for one half of the scanning period for any scanning electrode. Further, the white display period is equal in length for all the scanning electrodes.

By allocating one half of the scanning period to the reset period, and by providing only one selection period in the scanning period, as shown in FIG. 11, when the antiferroelectric liquid crystal is used as in the present embodiment, power consumption can be reduced since voltages of opposite polarities are not applied within the same frame period and no inversion current occurs.

Figure 12:
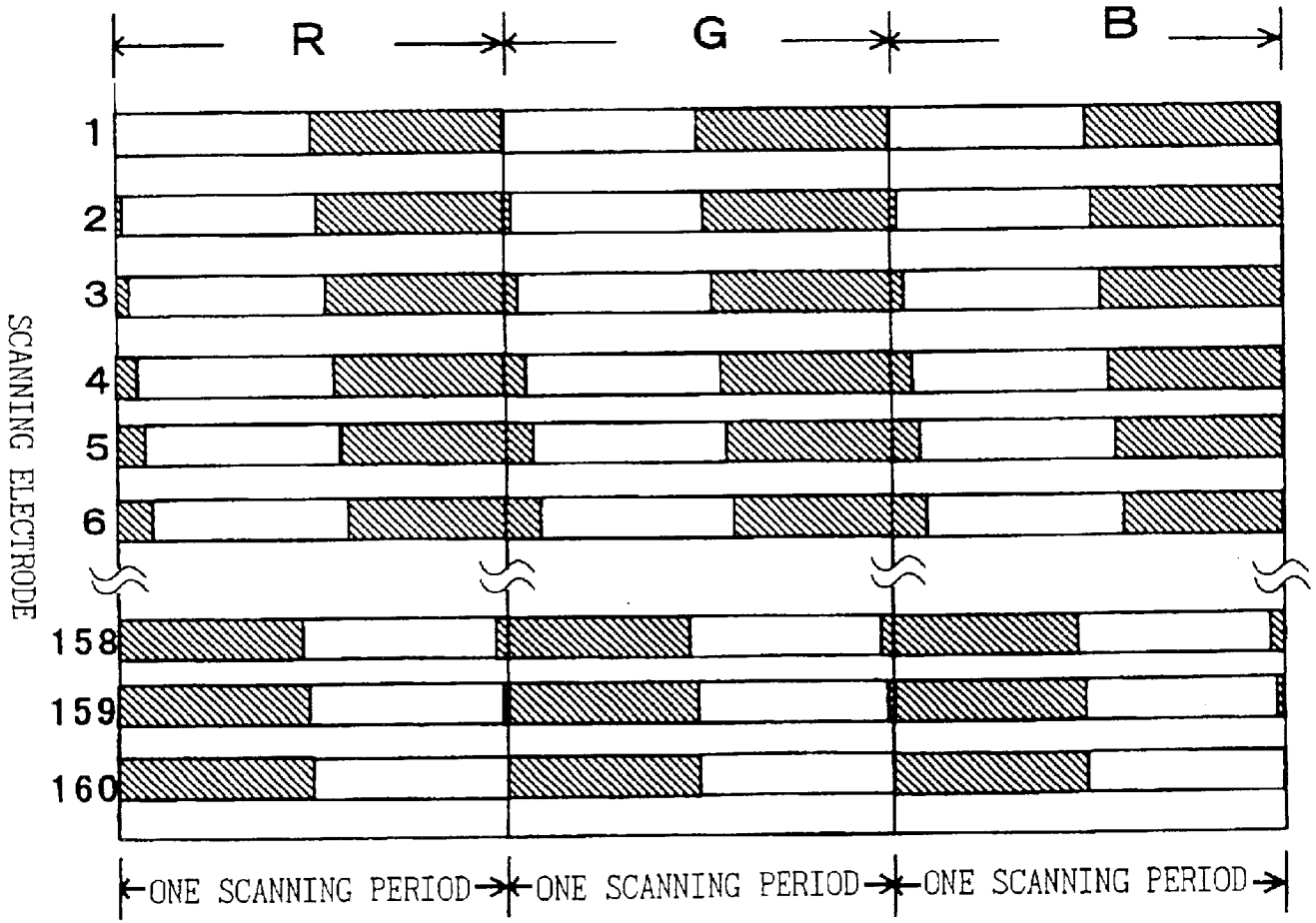
FIG. 12 is a graph showing the length of time that light is transmitted through pixels in white display state for each scanning electrode in the liquid crystal optical device according to the present invention.

The results of the above driving are shown in FIG. 12. In FIG. 12, the vertical axis represents the scanning electrode location, and the horizontal axis shows the color of the light source for each scanning period, along with the period of transmissive state (indicated by white portion), i.e., the length of time that the pixels on each scanning electrode are displayed in the white display state, and the period of non-transmissive state (indicated by shaded portion). As shown, though the period of non-transmissive state (shaded portion) is displaced from one scanning electrode to the next, the length of the period of transmissive state is equal for each color, the length being about 2.7 ms in the present embodiment. In this way, as the length of the ON period, i.e., the period of transmissive state (the combined length of the selection period and non-selection period) can be made equal for all the scanning electrodes, a good display with uniform brightness can be achieved over the display area of the liquid crystal panel.

(Embodiment 2)

Figure 5:
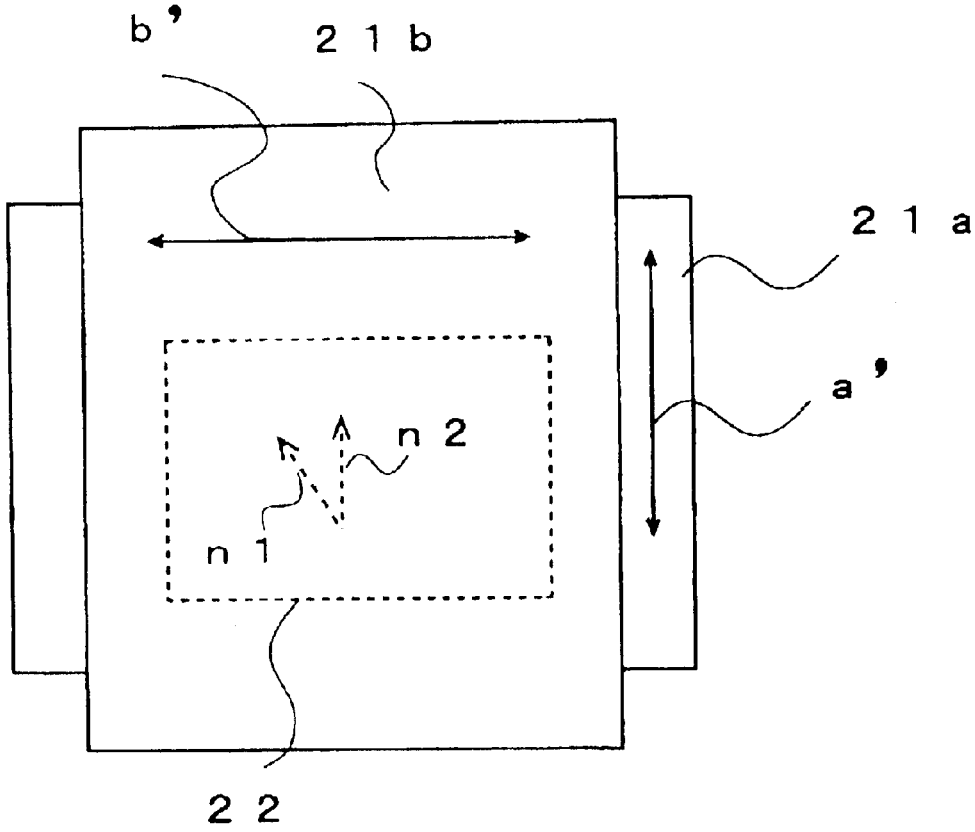
FIG. 5 is a diagram showing the arrangement of a ferroelectric liquid crystal panel and polarizers.
Figure 6:
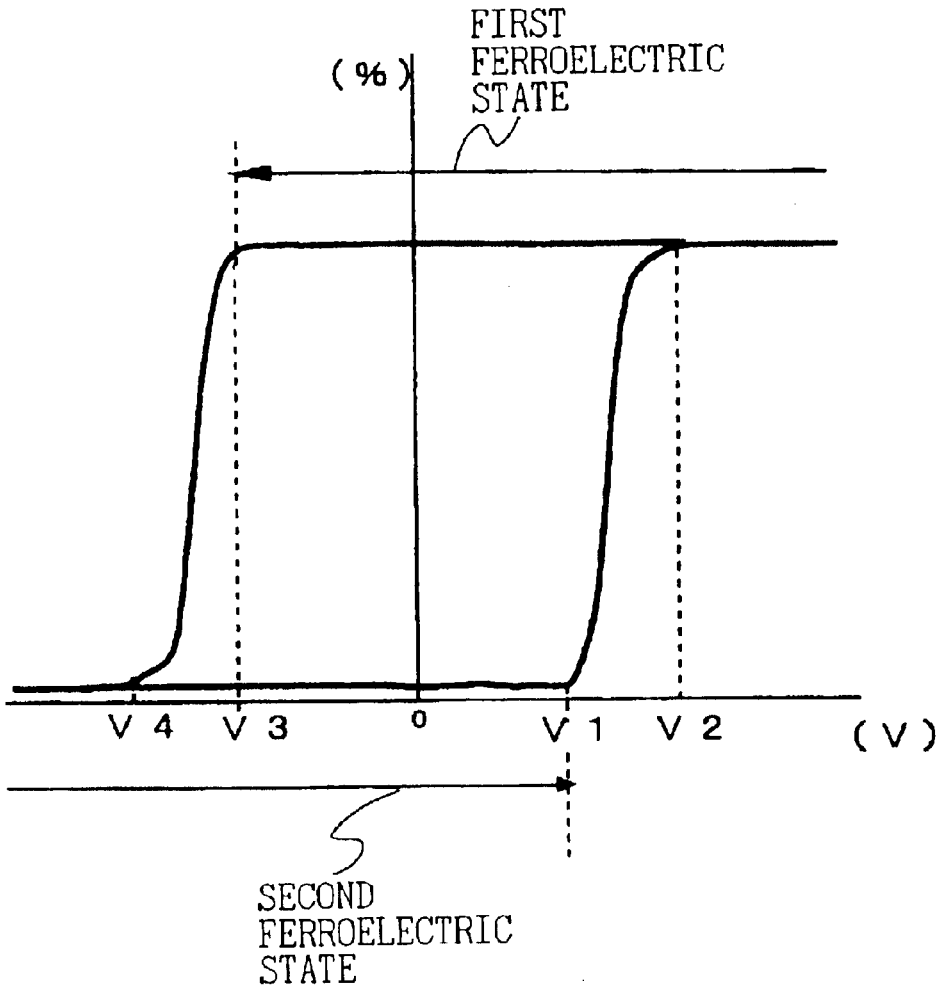
FIG. 6 is a diagram showing applied voltage and light transmittance for the ferroelectric liquid crystal panel.
Figure 7:
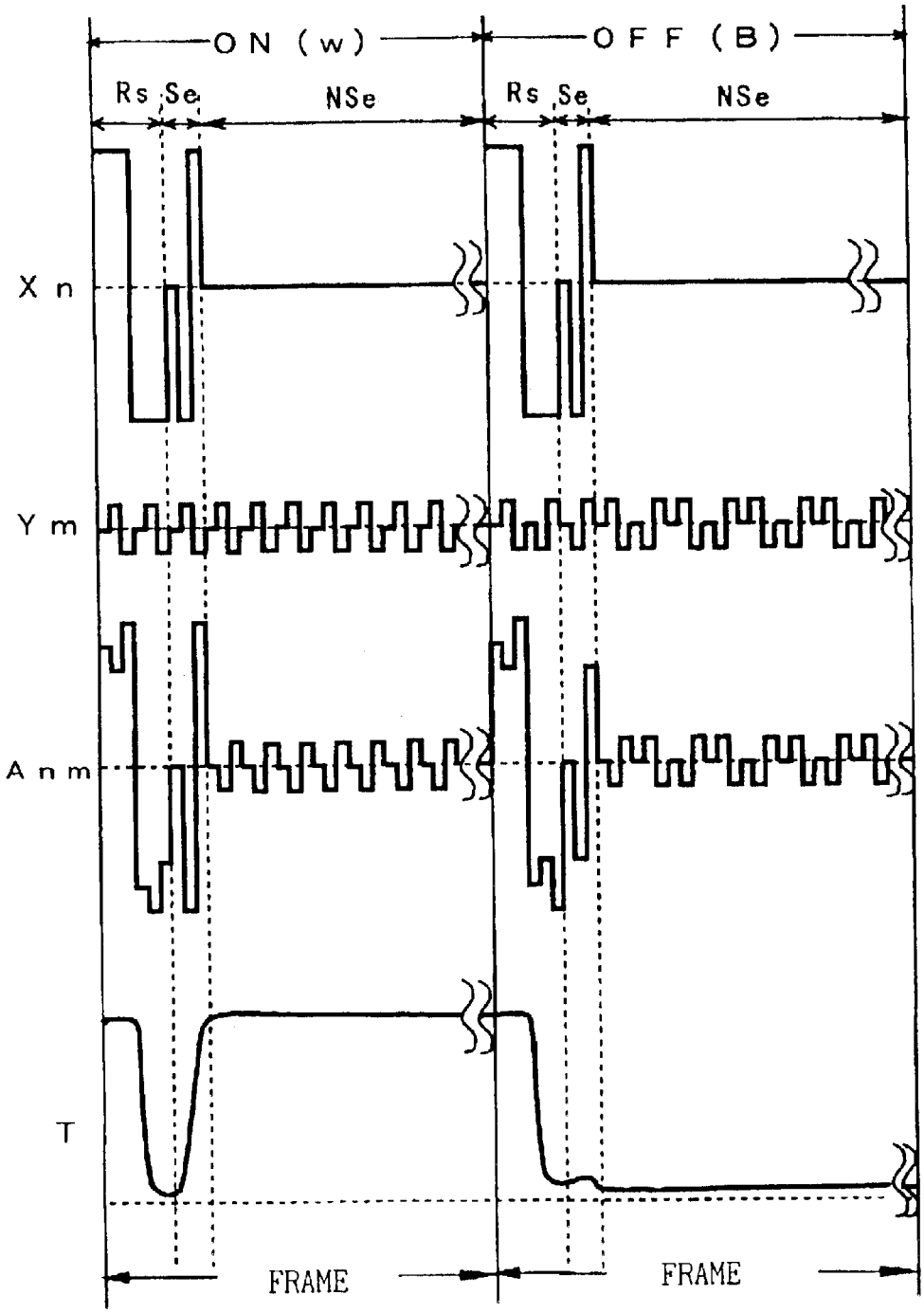
FIG. 7 is a diagram showing driving voltage waveforms and their corresponding light transmittance for a conventional art ferroelectric liquid crystal panel.
Figure 8:
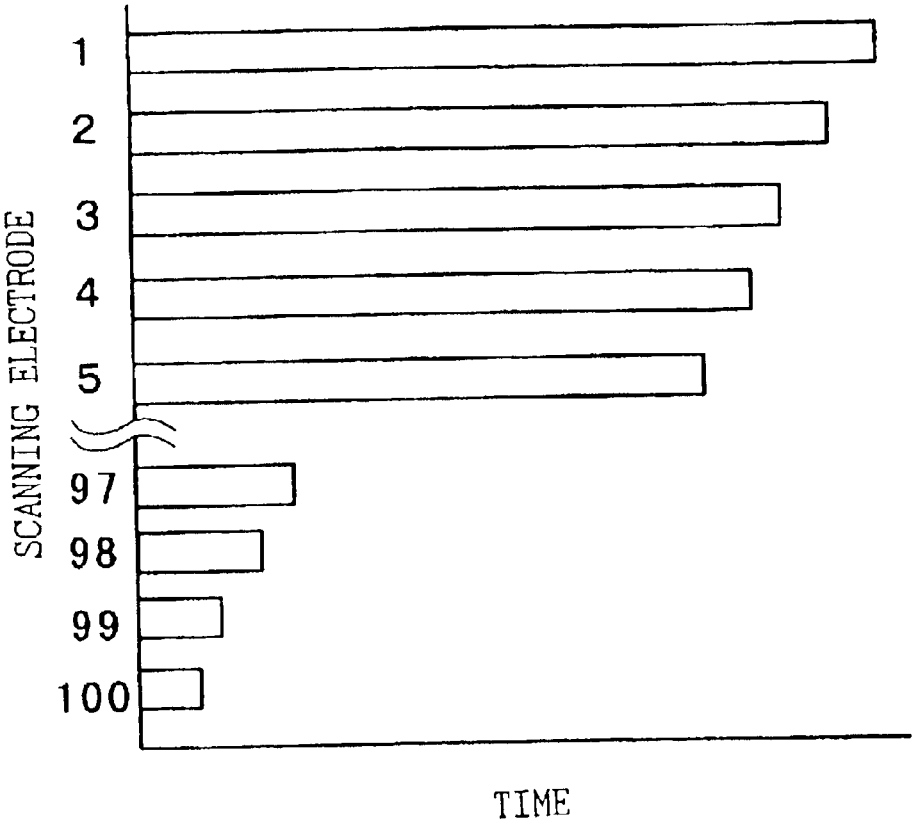
FIG. 8 is a graph showing the length of time that light is transmitted through pixels in white display state for each scanning electrode.

A second embodiment will be described in detail below with reference to drawings. In this embodiment, a ferroelectric liquid crystal is used as the liquid crystal material. The structure of the liquid crystal panel is the same as that of the first embodiment shown in FIG. 9. The electrode arrangement is also the same as that shown in FIG. 1, and the polarizers are arranged with the polarization axis of one of the polarizers oriented parallel to the direction of the liquid crystal molecules in the second-ferroelectric state, as previously described with reference to FIG. 5 in the description of the related art. Further, the thickness of the liquid crystal layer and the length of the emission period of each color to be emitted from the backlight are the same as those employed in the first embodiment.

Figure 13:
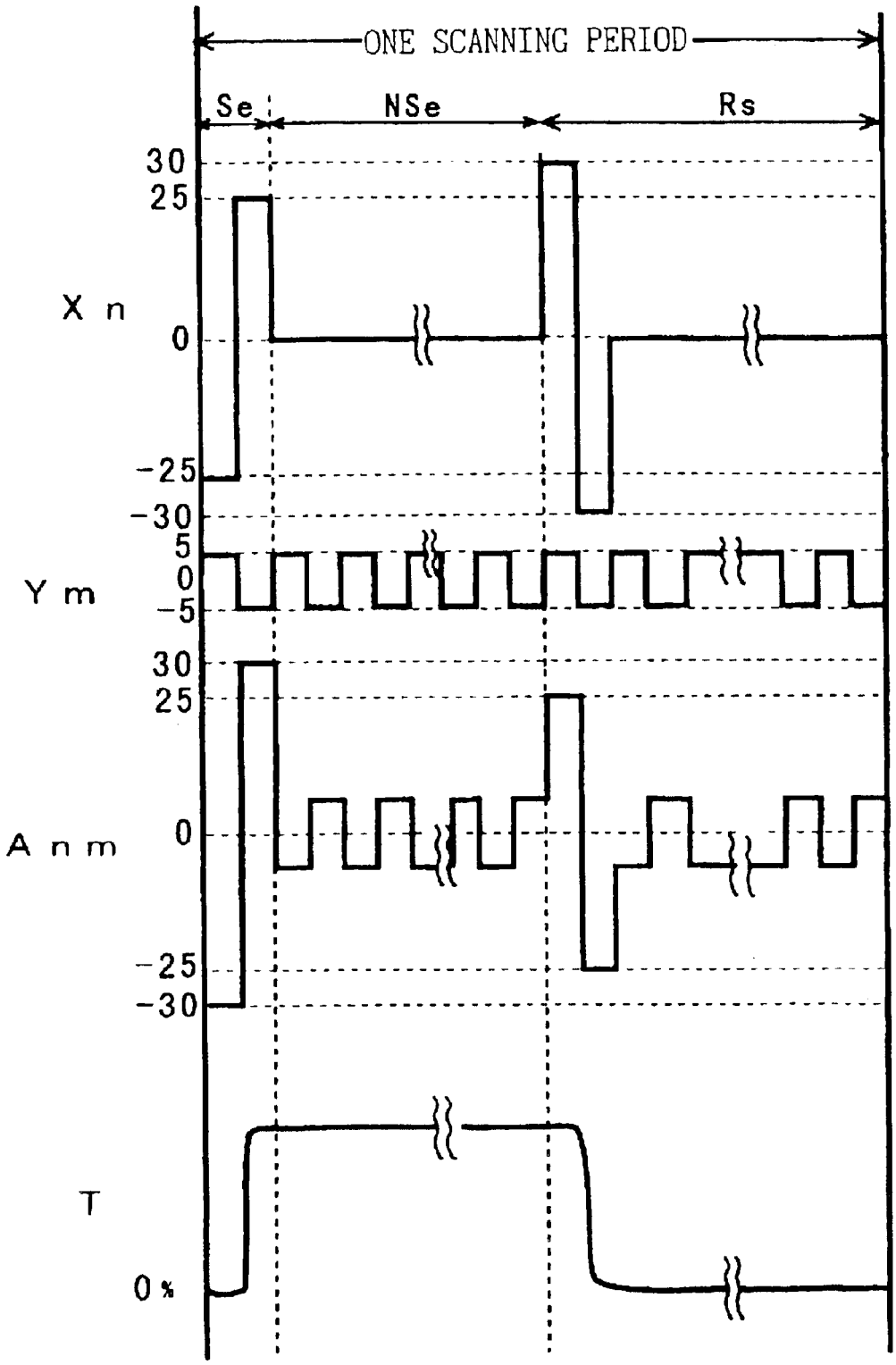
FIG. 13 is a diagram showing driving waveforms and their corresponding light transmittance for a liquid crystal optical device according to the present invention.

FIG. 13 shows the driving voltage waveforms according to the present invention when the ferroelectric liquid crystal panel is used. The driving waveforms are shown for the case when the period from the time one color is emitted to the time the light is switched to the next color is set as the scanning period, and when a white display state (ON(W)) is effected as the transmissive state. Besides the scanning voltage waveform applied to the scanning electrode (Xn) and the signal voltage waveform applied to the signal electrode (Ym), the sum driving voltage waveform applied to the pixel (Anm) located at their intersection and the amount of light transmission (T) changing with the sum voltage waveform are shown here. Though the scanning electrode and the signal electrode are designated by Xn and Ym, respectively, the sum driving voltage waveform shown is the waveform applied to the pixel at an arbitrary position, not specifically the pixel at the intersection of the 160th scanning electrode and signal electrode.

The scanning period (frame period), which is equal to the period from the time the light of one color is emitted to the time the light is switched to the next color, comprises a selection period, a non-selection period, and a reset period. The selection period (Se) consists of two phases, and the length of the selection period is set equal to one half the length of the scanning period divided by the total number of scanning electrodes. The length of the scanning period is 5.3 ms, which is the same as the period from the time the light of one color is emitted from the light source to the time the light is switched to the next color. As for the scanning voltage waveform applied to the scanning electrode (Xn), the pulse width of each phase in the selection period is set to about 8 $\mu$s and, in the selection period (Se), pulses of peak values of ±25 V are applied to the scanning electrode (Xn) in accordance with the display data while, in the non-selection period (NSe), a voltage of about 0 V is applied. The length of the reset period (Se) is set to 2.6 ms, which is one half the length of the scanning period and, at the beginning of the reset period, a two-phase pulse of ±30 V is always applied irrespectively of the display data, while in the remaining portion of the period, a voltage of 0 V is applied.

The signal voltage waveform applied to the signal electrode (Ym) is a pulse waveform of ±5 V, the pulse width varying according to the display data. Though not shown here, for each scanning period (each of the R, G, and B light emissions), that is, each time the color of the light source changes, the polarities of the scanning electrode voltage waveform and the signal electrode voltage waveform are inverted symmetrically about 0 V to prevent degradation of the liquid crystal by direct current.

When attention is paid to the transmittance of the pixel (Anm), in the selection period, a voltage of ±25 V is applied to the scanning electrode (Xn) and, for the second pulse in the selection period, a voltage of +30 V is applied as the sum voltage waveform to the pixel (Anm), thereby putting the ferroelectric liquid crystal in the first ferroelectric state, i.e., the high-transmittance white display state. In the non-selection period, this state is maintained, retaining the white display state. In the reset period that follows, the scanning electrode voltage waveform of ±30 V is applied, so that a sum voltage waveform of ±25 V is applied to the pixel (Anm) irrespectively of the display data; here, the second pulse in the reset period is −25 V, exceeding the threshold voltage and thus resetting the ferroelectric liquid crystal to the second ferroelectric state, i.e., the non-transmissive black display state.

Figure 14:
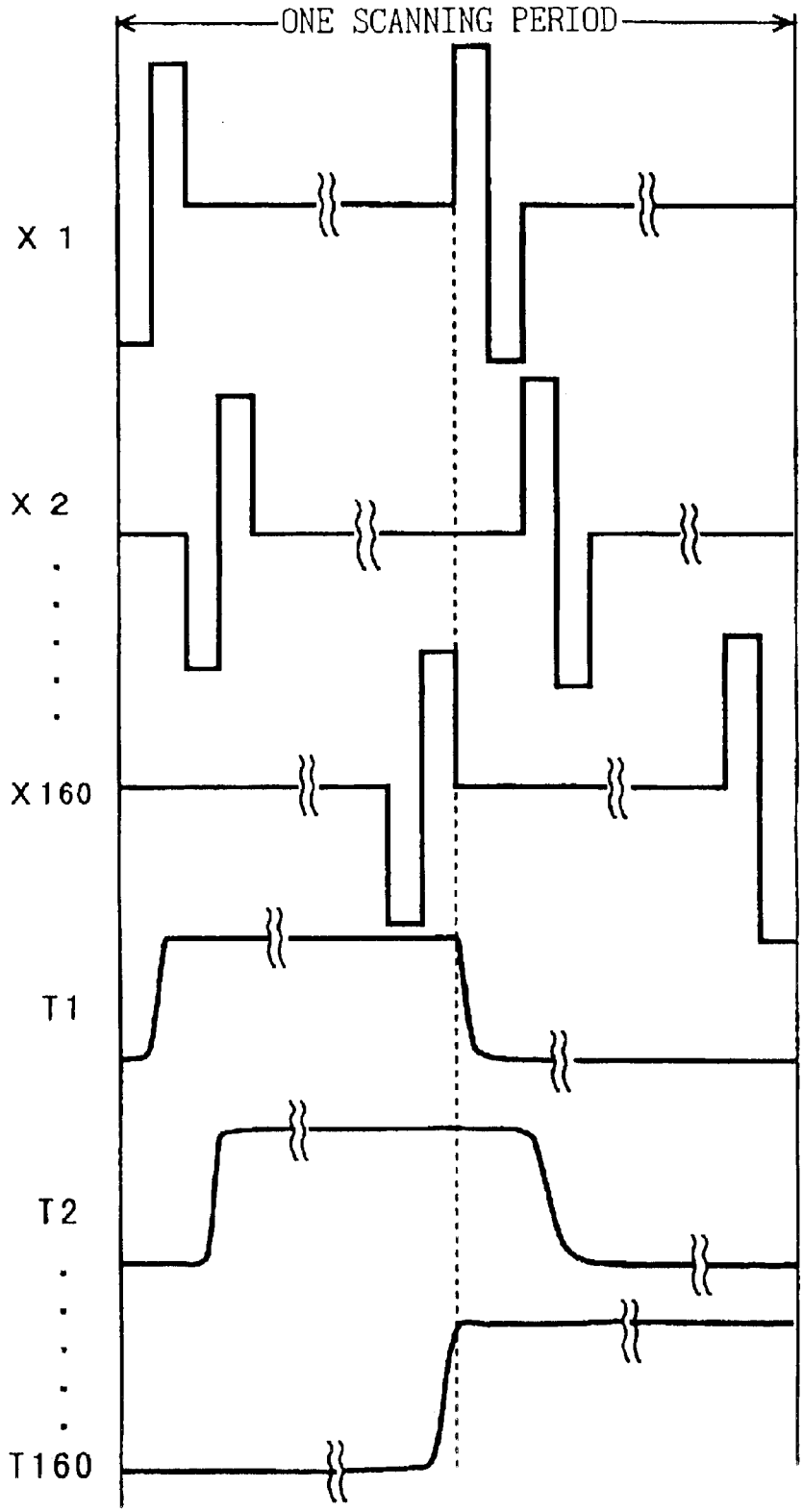
FIG. 14 is a diagram showing driving waveforms and their corresponding light transmittance for the liquid crystal optical device of the present invention.

While FIG. 13 has shown the driving waveforms for one particular pixel, FIG. 14 shows the scanning voltage waveforms applied to the first scanning electrode (X1), the second scanning electrode (X2), and the 160th scanning electrode (X160), and the amounts of light transmission (T1, T2, and T160) when the plurality of pixels on the respective electrodes are displayed in the white display state. As shown in FIG. 14, for X1, the second half of the scanning period is the reset period, and for X160, the selection period is located at the end of the first half. The pixels are reset to the non-transmissive state in the reset period; though the reset period is displaced from one scanning electrode to the next, the pixel are held in the black display state for one half of the scanning period for any scanning electrode. Further, the white display period is equal in length for all the scanning electrodes.

In this way, by making the reset period approximately equal in length to one half of the scanning period, the liquid crystal can be maintained in the black display state for about one-half the scanning period, and the length of time that light is transmitted through the pixels can be made equal for all the scanning electrodes. This achieves the same effect as described with reference to FIG. 12 in the foregoing first embodiment. As the length of time that light is transmitted through the pixels is equal, that is, about 2.7 ms, for all the scanning electrodes, a good display with uniform brightness can be produced over the entire display area of the ferroelectric liquid crystal panel.

In the present embodiment, the liquid crystal is reset to the non-transmissive black display state in the reset period. By thus resetting to the black display state in the reset period, good contrast can be obtained. However, rather than resetting the liquid crystal to the non-transmissive black display state, the liquid crystal may be reset in the reset period to a state of transmittance lower than a certain level; in that case also, the length of the period during which light is transmitted through the pixels can be made equal for all the scanning electrodes, and unevenness in brightness within the display area of the liquid crystal panel can be eliminated.

(Embodiment 3)

A third embodiment will be described in detail below with reference to drawings. In this embodiment, a TN type liquid crystal is used as the liquid crystal material, and an electrode configuration in which a TFT device as an active device is formed at each pixel location is used for the liquid crystal panel. The emission period of each color to be emitted from the backlight is the same as that in the first embodiment.

Figure 15:
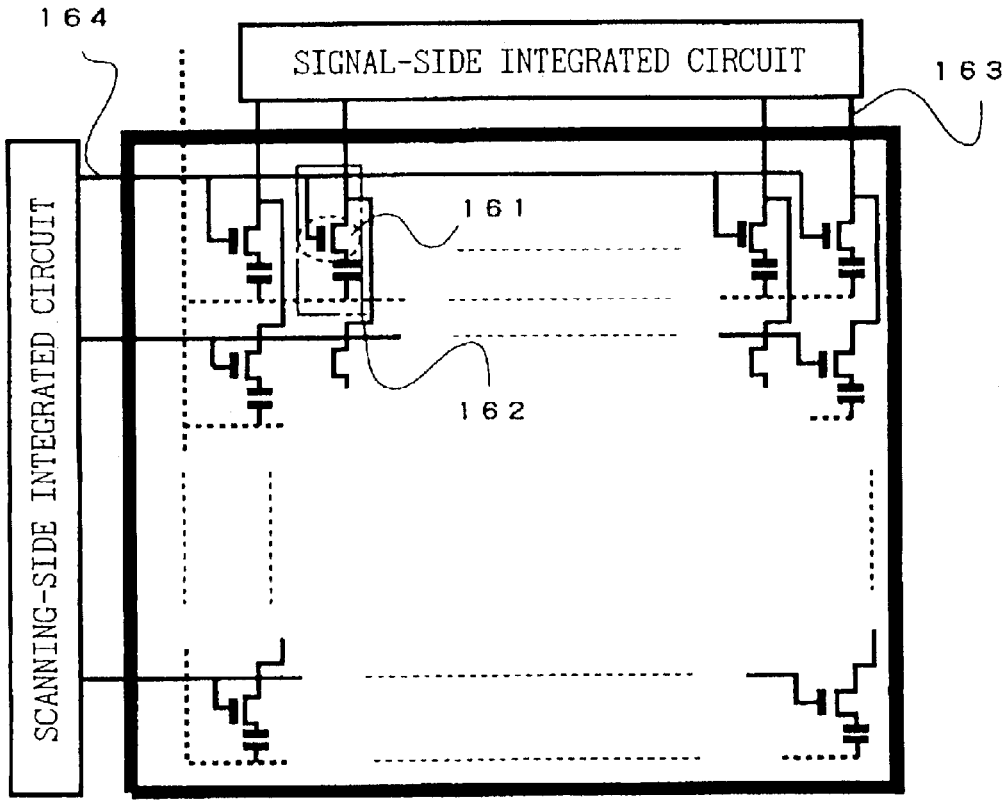
FIG. 15 is a diagram showing an active matrix type electrode configuration used in an embodiment of the present invention.

The present embodiment uses an active matrix liquid crystal display panel with a TFT device 161 formed within each pixel 162, as shown in FIG. 15. The TFT device is shown within a dotted circle. The source electrode of the TFT device is connected to a signal electrode 163 which is connected to a signal-side integrated circuit, while the gate electrode of the TFT device is connected to a scanning electrode 164 which is connected to a scanning-side integrated circuit. Voltages of −5 V and +15 V are applied from the scanning electrode to the gate of the TFT device, while voltages of 0 V and +5 V are applied from the signal electrode to the source electrode. The number of signal electrodes is 320, and the number of scanning electrodes is 250.

Figure 16:
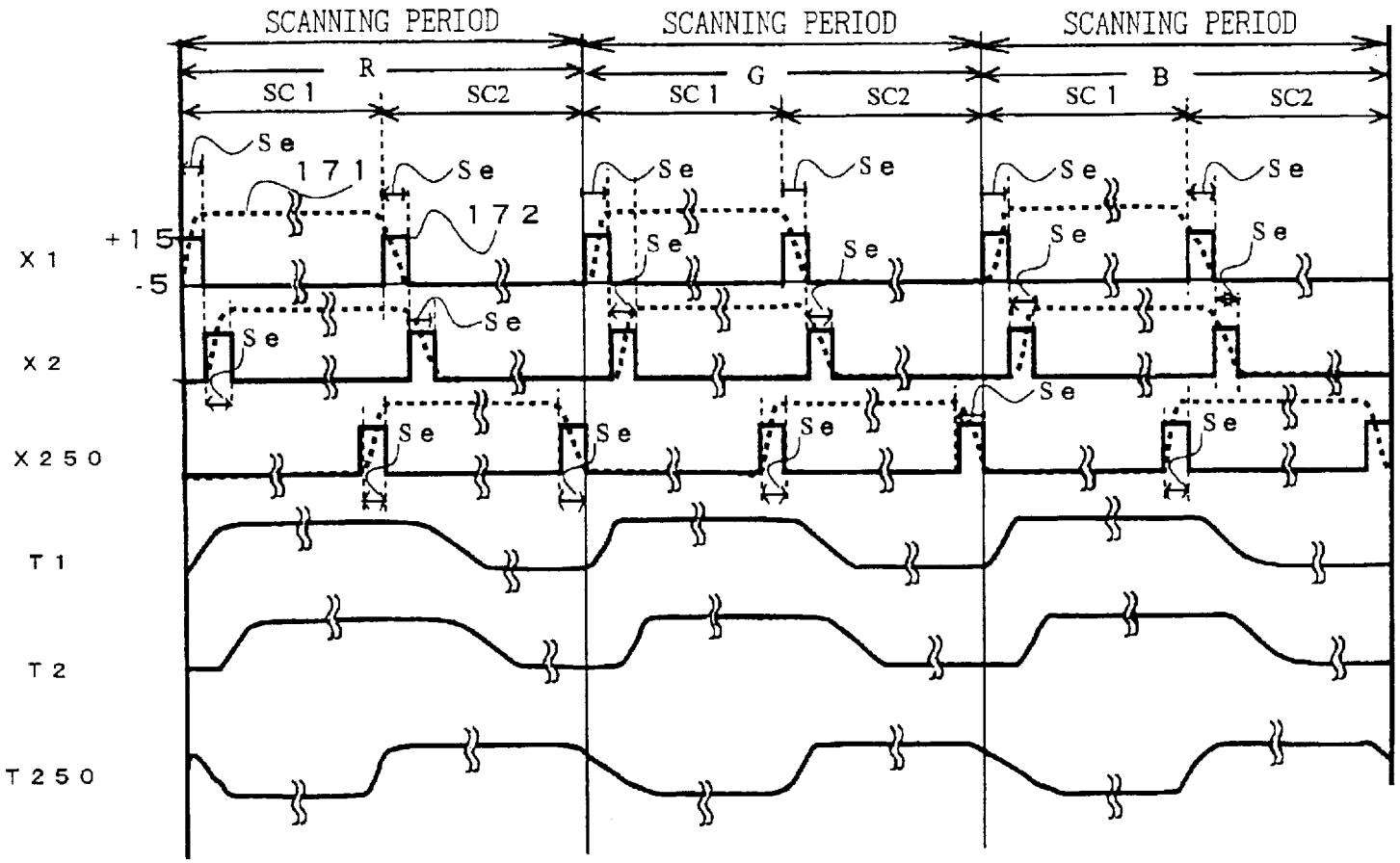
FIG. 16 is a diagram showing driving waveforms and their corresponding light transmittance for a liquid crystal optical device according to the present invention.

The backlight emits colored lights of R, G, and B in sequence, as in the first embodiment. The emission time of each color is about 5.4 ms. The period from the time one color is emitted to the time the light is switched to the next color is set as the scanning period (frame period), and the scanning period consists of a selection period and a reset period. FIG. 16 shows the scanning voltage waveforms applied to the first scanning electrode (X1), the second scanning electrode (X2), and the 250th scanning electrode (X250), and the amounts of light transmission (T1, T2, and T250) when the plurality of pixels on the respective electrodes are displayed in the white display state. As shown in FIG. 16, in the present embodiment, each scanning period is divided into two equal parts, the first period (SC1) and the second period (SC2), the second period being the reset period (Rs). In the first period (SC1), the period during which a voltage is applied to the scanning electrode is set as the selection period (Se). Accordingly, the corresponding voltages are applied to all the scanning electrodes within one scanning period. The first period and the second period of the scanning voltage waveform applied to the second scanning electrode are displaced from the corresponding periods of the first scanning electrode by the length of the selection period. In this way, the first and second periods are displaced by the length of the selection period from one scanning electrode to the next.

In the first period, a display is produced in accordance with the display data and, in the second period, the pixels are forced into the black display state irrespectively of the display data. In the selection period, a pulse of +15 V is applied for about 11 $\mu$s, in sequence, starting from the first scanning electrode. The voltage waveform applied to each scanning electrode is indicated by solid line 172. A dashed line 171 indicates the potential state of the liquid crystal layer when the TFT device is ON and a voltage is applied from the source electrode to the liquid crystal layer. The display mode used is a TN mode that produces a black display when no voltage is applied. As the potential of the liquid crystal layer rises, the liquid crystal starts switching and the transmittance increases accordingly. Therefore, in the second period, i.e., the reset period, the potential of every liquid crystal is held at 0 V irrespectively of the display data, causing the transmittance to decrease and thus effecting the black display state.

As shown in FIG. 16, for X1, the second half of the scanning period is the reset period, while for X250, the first half is the reset period. The pixels are reset to the non-transmissive state in the reset period; though the reset period is displaced from one scanning electrode to the next, the pixels are held in the black display state for one half of the scanning period for any scanning electrode. Further, the white display period is equal in length for all the scanning electrodes. As a result, a good display with uniform brightness can be produced over the entire display area of the liquid crystal panel.

In the above embodiment, the liquid crystal panel has been constructed by combining the TN type liquid crystal with TFT devices, but it will be appreciated that the same effect can be obtained if the STN type liquid crystal or other type of liquid crystal having ferroelectric properties is used in place of the TN type liquid crystal.

What is claimed is:

1. A liquid crystal optical device comprising: a liquid crystal panel for displaying display data using pixels with a liquid crystal sandwiched between a pair of substrates having a plurality of electrodes on opposing surfaces thereof; and a light source for emitting different colored lights, wherein a period from the time any one of said colored lights is emitted to the time switching is made to another one of said colored lights is set as a scanning period, and for each of said electrodes, said scanning period comprises a selection period for determining a transmittance state based on said display data and a reset period for resetting said pixels to a certain transmittance state irrespectively of said display data, and wherein the length of said reset period is approximately equal to one half the length of said scanning period.

2. A liquid crystal optical device as claimed in claim 1 wherein, in said reset period, the transmittance state of said pixels is reset to a non-transmissive state.

3. A liquid crystal optical device as claimed in claim 1, wherein said electrodes of said liquid crystal panel consists of a plurality of scanning electrodes and signal electrodes, and the length of said selection period multiplied by the number of scanning electrodes is approximately equal to one half the length of said scanning period.

4. A liquid crystal optical device as claimed in claim 1, wherein said liquid crystal is an antiferroelectric liquid crystal which exhibits a first ferroelectric state when a voltage of a first polarity is applied, a second ferroelectric state when a voltage of a second polarity is applied, and an antiferroelectric state when no voltage is applied.

5. A liquid crystal optical device as claimed in claim 4, wherein said liquid crystal panel includes a pair of polarizers, said pair of polarizers being arranged so that a polarization axis of either one of said polarizers is oriented substantially parallel to an average molecular direction of said antiferroelectric liquid crystal in said antiferroelectric state and wherein, in said reset period, said antiferroelectric liquid crystal is reset to said antiferroelectric state.

6. A liquid crystal optical device as claimed in claim 5, wherein said electrodes of said liquid crystal panel consist of scanning electrodes and signal electrodes and, in said reset period, a voltage of 0 V is applied to each of said scanning electrode.

7. A liquid crystal optical device as claimed in claim 1, wherein said liquid crystal is a ferroelectric liquid crystal which exhibits a first ferroelectric state when a voltage of first polarity is applied and a second ferroelectric state when a voltage of second polarity is applied.

8. A liquid crystal optical device as claimed in claim 7, wherein said liquid crystal panel includes a pair of polarizers, said pair of polarizers being arranged so that a polarization axis of either one of said polarizers is oriented substantially parallel to an molecular direction of said ferroelectric liquid crystal in said second ferroelectric state and wherein, in said reset period, said ferroelectric liquid crystal is reset to said second ferroelectric state.

9. A liquid crystal optical device as claimed in claim 1, wherein said liquid crystal panel includes an active device for each of said pixels.

* * * * *